US005131732A

United States Patent [19]

Lane et al.

[11] Patent Number: 5,131,732

[45] Date of Patent: Jul. 21, 1992

[54] STORAGE CABINET SYSTEM FOR RETRACTABLY VIEWING INDIVIDUAL GROUPINGS OF DOCUMENTS

[75] Inventors: Tara Lane; Edward C. H. Lai, both of New York, N.Y.

[73] Assignee: Lanescape Inc., New York, N.Y.

[21] Appl. No.: 480,299

[22] Filed: Feb. 15, 1990

[51] Int. Cl.[5] ..... A47B 63/00

[52] U.S. Cl. ..... 312/190; 312/311

[58] Field of Search ..... 248/453; 312/348, 323, 312/190, 191, 311

[56] References Cited

U.S. PATENT DOCUMENTS

| | | | |
|---|---|---|---|
| 313,768 | 3/1885 | Pringle et al. | 312/241 X |
| 322,663 | 7/1885 | Welch | 312/190 X |
| 745,982 | 12/1903 | Yawman | 312/190 X |
| 1,875,785 | 9/1932 | Waples | 248/453 |
| 2,742,161 | 4/1956 | Nutall . | |
| 2,812,067 | 11/1957 | Gussack . | |
| 2,853,355 | 9/1958 | Paca et al. | 312/311 |
| 3,190,242 | 6/1965 | Shelly . | |
| 3,887,076 | 6/1975 | Larsen . | |
| 3,899,082 | 8/1975 | Young et al. . | |
| 3,913,995 | 10/1975 | Malcik et al. . | |
| 4,515,420 | 5/1985 | Grosch . | |
| 4,725,108 | 2/1988 | Wilson | 312/348 |

*Primary Examiner*—Joseph Falk

*Attorney, Agent, or Firm*—Gottlieb, Rackman & Reisman

[57] ABSTRACT

A system for filing and storing documents is provided. The system comprises a file cabinet consisting of at least one compartment having a plurality of individually slidable storage units. Each storage unit consists of a pocket for retaining a series of documents. When the storage unit is pulled outwardly from the housing of the file cabinet, the documents retained in the pocket remain neatly organized and readily accessible. Further, easy identification of the documents retained in the pockets of the storage units is achieved. Each storage unit includes a slanted wall on which the documents stored therein are supported, a retaining arm for maintaining the documents fixed in the pocket and an assembly which allows movement of the unit, all of which are designed to enhance and facilitate the filing of documents.

26 Claims, 4 Drawing Sheets 10
11
15
16
25
23
17
90
20
25
50
20
25
74
41
40
20
22
37
58
14
21
58
60
14
18

80
45
41
70
72
98
95
97
100
40
85
73
105
170
102
206
160
165
205
202a
20
71
150
175
180
185
202b
200
215
75
155

STORAGE CABINET SYSTEM FOR RETRACTABLY VIEWING INDIVIDUAL GROUPINGS OF DOCUMENTS

BACKGROUND OF THE INVENTION

This invention is directed to a system for enabling the economical organization and easy accessibility of the ever increasing amount of documentation produced in a normal business office. More particularly, the invention relates to a storage cabinet system consisting of at least one compartment, where the compartments are fixed, but where each compartment is comprised of a plurality of individually slidable storage units for the storage of documents.

File cabinets are old in the art. They usually consist of whole drawers which are retractable and which contain within them individual papers, envelopes, or large groupings of connected papers. However, such a filing system creates disarray, often individual papers are hopelessly disorganized and any labels on filed folders are difficult to read. Therefore, constant removal and replacement of the envelopes or folders are required.

Still other filing systems resemble book shelves in that individual folders of documents are labeled on their side binder and are slid in and out from the cabinet shelf. Cabinets of this manufacture are normally conducive to the filing of large folders, and not the filing of individual papers. Consequently, although it can be seen that file cabinet systems are old in the art, experience with conventional file cabinets leave much to be desired in view of the need for easily locatable and accessible documents.

Accordingly, it would be desirable to provide a system of document storage where not only bulk folders of documents, but also individual documents, could be easily stored and retrieved through the use of individual sliding units. Each unit would slide independently of every other unit in a compartment, and the leading surface of each unit would be so situated that easy-to-read identification descriptions could be placed thereon, such that the system would provide an organized method of document storage.

SUMMARY OF THE INVENTION

Generally speaking, in accordance With the invention, a system for filing and storing documents is provided. The system comprises a file cabinet consisting of at least one substantially horizontal compartment having a plurality of individually slidable storage units. Each storage unit consists of a pocket for receiving a series of documents. When an individual storage unit is retracted out from the housing of the file cabinet, the documents contained in the pocket of the unit are neatly organized and readily accessible. Each of the storage units also includes an identification marking that is visible when the unit is hidden inside of the cabinet housing.

The pocket of the storage unit consists of four substantially vertical walls and one bottom wall. One of the vertical walls is larger in height than the other three vertical walls to facilitate ease of access to the documents contained in the storage unit. The larger wall is slanted from the vertical to supply continued support to documents retained in the pocket of the storage unit.

A document retaining arm is also provided for holding documents retained in the unit in an organized, stacked position. The retaining arm provides continuous pressure to maintain the documents against the large, slanted wall of the pocket.

Contained within the construction of each storage unit, but located underneath the bottom wall of the pocket thereof, is an assembly which enables each storage unit to be pulled in and out of the cabinet.

Accordingly, it is the object of the invention to provide a cabinet system which organizes documents used in an office.

Another object of the invention is to provide a cabinet system whereby ease of visibility and access to documents is substantially enhanced.

Still another object of the invention is to give the individual storage units slidability, so that the individual units can be retractably used to view and access documents.

Yet a further object of the invention is to securely retain documents within the system when a storage unit is in either its hidden or retracted position.

Still a further object of the invention is to provide a location whereby identification markings can be readily positioned such that even when one or more of the individual slidable units are in their position out from the cabinet housing, all of the identification markings can be easily read.

A further object of the invention is to create a cabinet system whereby different variations of the overall system will be combined so as to effectively provide easy organization and access to documents from either a sitting position or a standing position.

Still other objects and advantages of the invention will in part be obvious and will in part be apparent from the specification.

The invention accordingly comprises a system possessing the features, properties, and the relation of elements which will be exemplified hereinafter, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
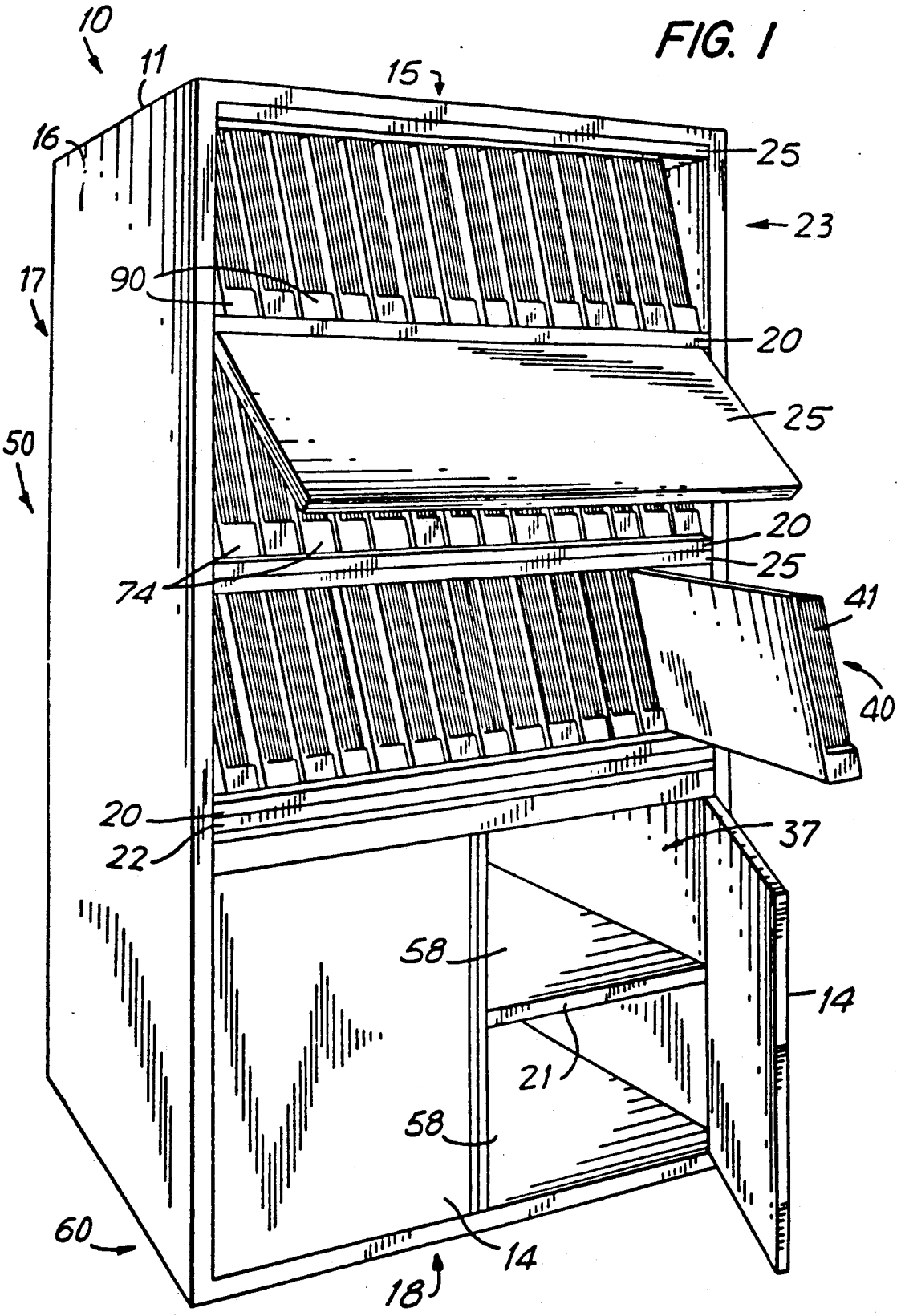
FIG. 1 is a perspective view of the cabinet system made in accordance with the subject invention.

Referring first to FIG. 1, a first embOdiment of a storage cabinet system for filing documents in an organized and accessible manner is generally indicated at 10. Cabinet system 10 includes a housing 11 defined by a top 15, a bottom 18, a back 17 (not shown) and sides 16, all of which are preferably constructed of metal sheets. Housing 11 has an upper portion generally shown at 50 containing three compartments 23 and a lower portion generally shown at 60 defining an enclosure 37.

Enclosure 37 of lower portion 60 is adapted for the random storage of normal office paraphernalia. Enclosure 37 is divided into two horizontal compartments 58 by a shelf 21. Enclosure 37 is also concealable from view by operation of hinged doors 14, as is well known in the art.

Upper portion 50 and lower portion 60 of housing 11 are separated by a retractable platform 22. Retractable platform 22 is shown in its hidden position in FIG. 1. Platform 22 may be retracted outwardly to an operational position for use as an extra work surface, writing area or computer shelf.

In contrast to the prior art storage cabinet systems which located a retractable platform between two of the compartments 23, the present invention has retractable platform 22 located in an operational position between upper portion 50 and lower portion 60. In this operational position, platform 22 is useable from a sitting position whereas no prior art platform located between the compartments 23 could be used from a sitting position.

Each of compartments 23 of upper portion 50 is separated by a substantially horizontal supporting platform 20. Each of platforms 20 slidably support the storage units of the invention disposed directly above the platform, as described below. Each of compartments 23 may be concealed from view by a retractable front panel 25. Panel 25 is movable from a first hidden position within housing 11 directly below respective platform 20 to a second visible position to conceal compartments 23, as is well known in the art.

Each of compartments 23 includes a plurality of horizontally running storage units 40. As described in greater detail below, storage units 40 are used for storing a series of documents 41. Each of storage units 40 may be moved from a first hidden position located within respective compartment 23 to a second retracted position substantially forward of compartment 23.

Figure 2:
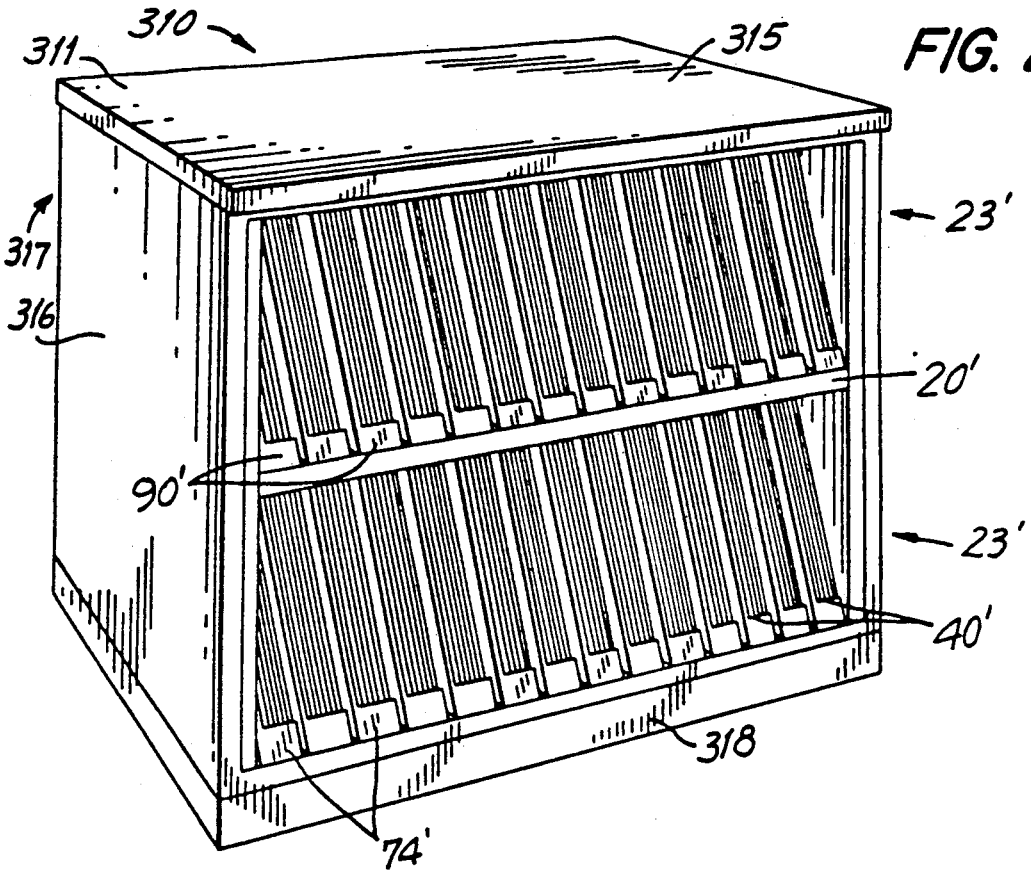
FIG. 2 is a perspective view of a second embodiment of the cabinet system made in accordance with the subject invention.

Turning now to FIG. 2, a second embodiment of the cabinet system of the invention is generally shown at 310. Cabinet system 310 has housing 311 defined by a top 315, a bottom 318, sides 316 and a back 317 (not shown). Housing 311 includes two horizontal compartments 23' separated by a supporting platform 20'. Each of compartments 23' has a plurality of storage units 40' which are slidably accessible, similar to units 40 illustrated in FIG. 1. The embodiment shown in FIG. 2 is designed to be accessible from a sitting position.

Figure 3:
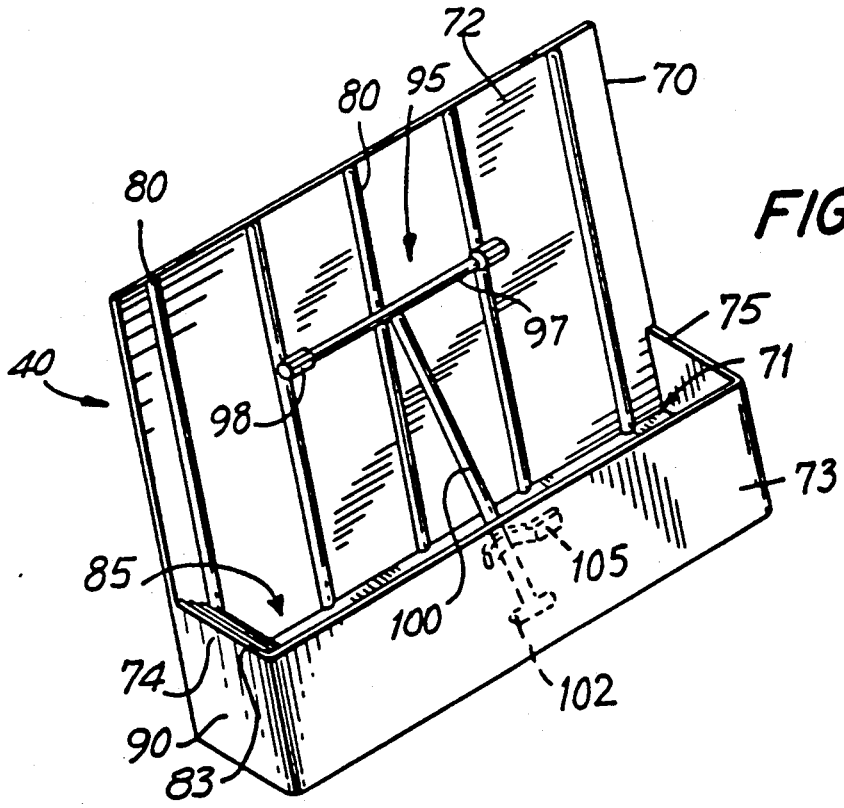
FIG. 3 is a perspective view of an individual slidable storage unit made in accordance with the subject invention.
Figures 6, 7, 8:
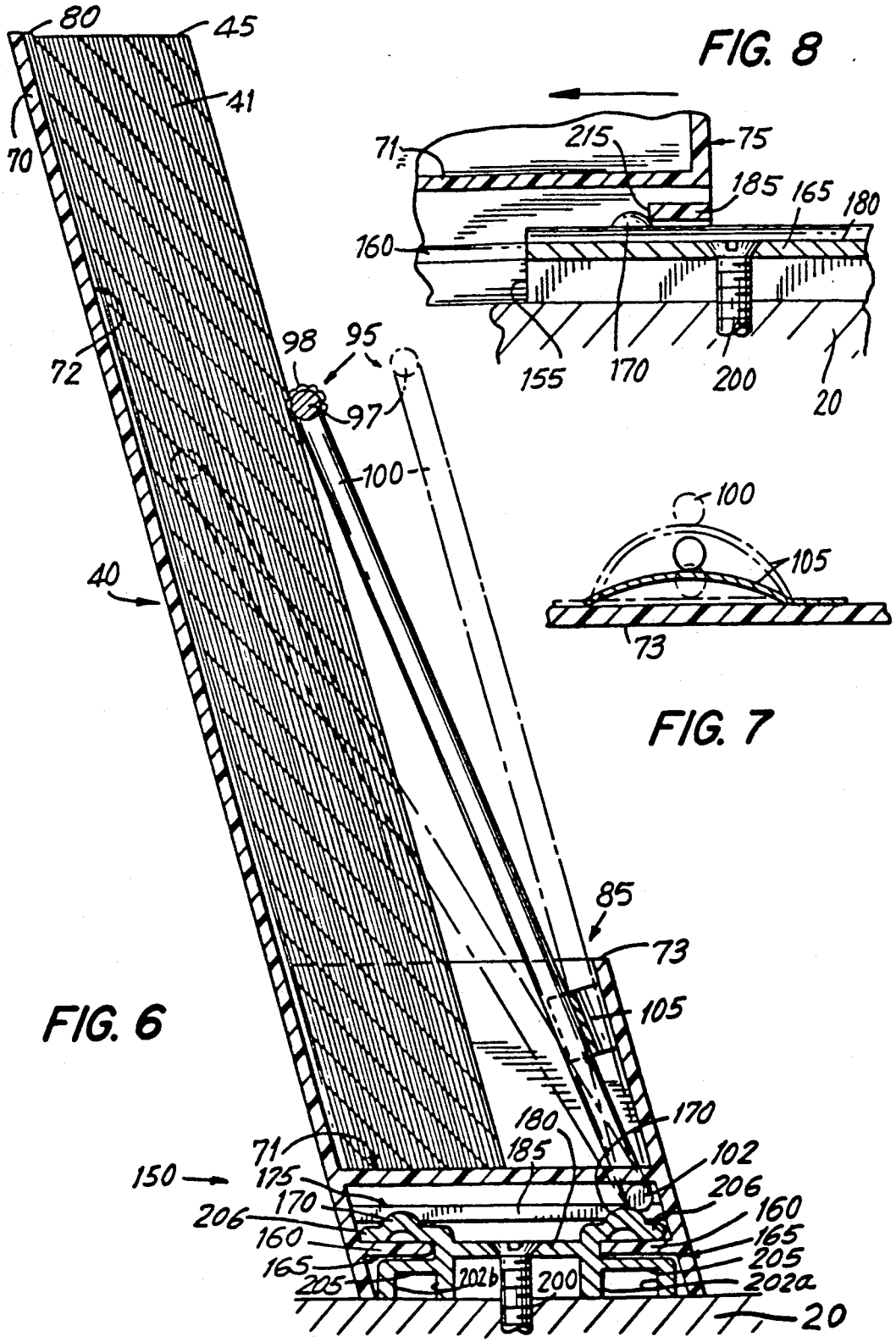
FIG. 6 is a cross-sectional view taken along line 6—6 of FIG. 4 showing the document retaining arm of the inventive storage unit in different positions and the slide assembly used to enable the unit to be selectively pulled out of the cabinet system.
FIG. 7 is a cross-sectional view taken along line 7—7 of FIG. 5 and showing the action of the spring for operating the document retaining arm.
FIG. 8 is a cross-sectional view of the slide assembly previously illustrated in FIG. 6.

Turning now to FIG. 3, storage unit 40 (or 40') made in accordance with the invention is further described and includes a document storage pocket generally indicated at 85. Pocket 85 is defined by a first side wall 70, a bottom wall 71, a second side wall 73, a front wall 74 and a rear wall 75. Storage unit 40 also includes a movement enabling assembly generally indicated at 150, as shown in FIG. 6 and discussed in more detail hereinbelow. In general, however, movement enabling assembly 150 is located below pocket 85 and is defined on its top by bottom wall 71 and on its sides by first side wall 70, second side wall 73 and front wall 74. However, rear wall 75 does not extend below bottom wall 71 and, consequently, movement enabling assembly 150 is not enclosed at the rear thereof.

Side wall 70 of pocket 85 is constructed with a series of ribs 80 running substantially vertically along the inside surface thereof. Ribs 80 of side wall 70 add stiffness to wall 70 so that wall 70 can better support document loads resting thereon. Further, ribs 80 keep documents 41 from touching wall 70 so that retrieval of the document 41 closest to wall 70 is made easier.

Side wall 70 is preferably slanted outwardly from vertical, as shown best in FIG. 6. The slant of wall 70 is substantially at an angle of 15 degrees from the vertical. The slant reduces the tendency of documents 41, retained by storage unit 40, to curl at their upper edges 45, which occurs in many prior art cabinet systems, and also creates a fanned array of the upper edges 45 making retrieval of documents 41 easier. Slanting of side wall 70 also provides a paper support on which documents 41 may rest, whether or not storage unit 40 is in its first hidden position or its second retracted position.

In order to maximize the number of storage units 40 located in a single compartment 23 side wall 73 is slanted in the same direction as side wall 70, as shown in FIG. 6. Thus, side wall 73 of one storage unit 40 located in compartment 23 is located next to side wall 70 of the most adjacent storage unit 40, as best illustrated in FIGS. 1 and 2.

Figure 4:
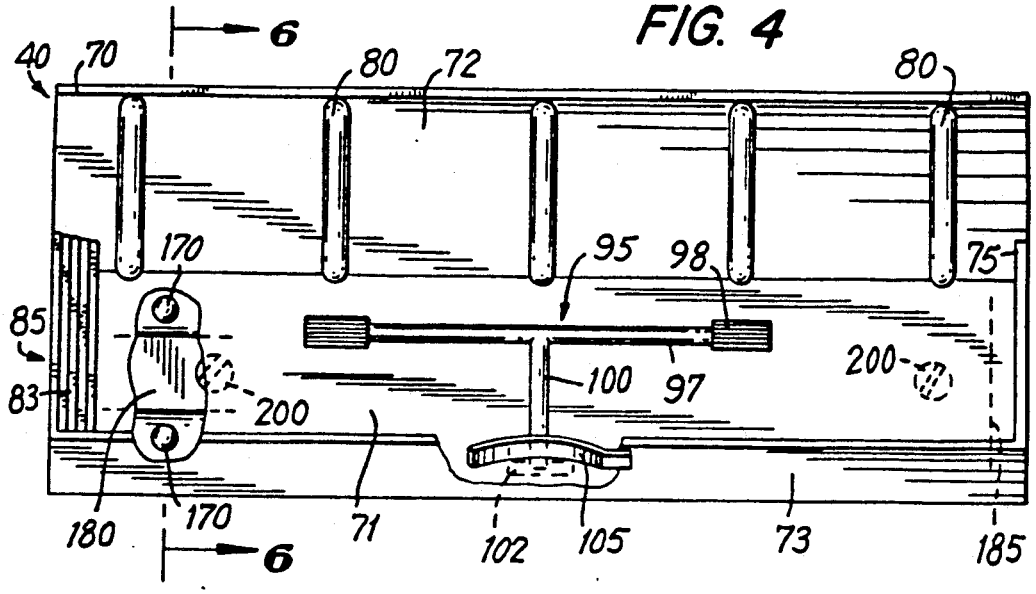
FIG. 4 is a top plan view of the slidable storage unit of FIG. 3 made in accordance with the invention.

Referring again to FIG. 3, and also referring to FIGS. 4 and 6, each of storage units 40 is provided with a document retaining arm 95 for selectively holding documents 41 in place within pocket 85 of unit 40. Retaining arm 95 consists of retaining post 100 having an anchor 102 disposed below a slot formed in bottom wall 71. Anchor 102 prevents arm 95 from lifting or displacing in a vertical direction since anchor 102 has a length dimension which is larger than the width of the slot formed in wall 71.

Post 100 of retaining arm 95 has perpendicular extending rod 97 attached across the end thereof. Rod 97 has a length which enables it to extend over approximately 50% of the width of wall 70. This feature provides for a wide surface area on wall 70 where documents may be held in position by arm 95.

Rod 97 includes a pair of roller guides 98 located at either end thereof. Roller guides 98 enable easy removal of documents 41 retained by storage unit 23. Guides 98 are slidably rotatable when contacting a document 41 retained in unit 40. This feature prevents smudging or tearing of documents 41 when they are removed from unit 40, as is well known in the art.

As shown in FIGS. 3, 4 and 7, retaining arm 95 is urged against documents 41 retained in unit 40 by a spring 105 attached to the inside surface of wall 73 of pocket 85. As shown more clearly in FIGS. 6 and 7, spring 105 exerts a force substantially perpendicular to post 100 of retaining arm 95. Consequently, retaining arm 95 is always urged towards side wall 70, maintaining documents 41 supported thereon in a substantially fixed position.

Removal of documents 41 from storage unit 40 normally takes place when unit 40 is in its second retracted position forward of housing 11. One method of removing documents 41 is to contract spring 105. Spring 105 is contracted by displacing retaining arm 95 away from documents 41. This relieves the pressure exerted upon documents 41 by arm 95, freeing documents 41 for removal. A second method of removing documents 41 is to leave retaining arm 95 in contact with them while sliding documents 41 out from pocket 85. When the second method is used, roller guides 98 enable documents 41 to be removed without smudging or tearing, as discussed above.

As shown in FIGS. 1, 2 and 3, front wall 74 of pocket 85 acts as a label panel 90 for easy visibility of document identification markings. Panel 90 enables the user of the cabinet system 10 to easily locate documents 41 stored within one of the storage units 40. Unlike prior art cabinet systems, a panel 90 is supplied at a location which directly references the specific storage unit 40 which holds the required documents, not an entire shelf or drawer of stored papers. Further, the identification markings of all of the storage units 40 are clearly visible on all of the panels 90 despite the hidden or retracted position of adjacent storage units.

Figure 5:
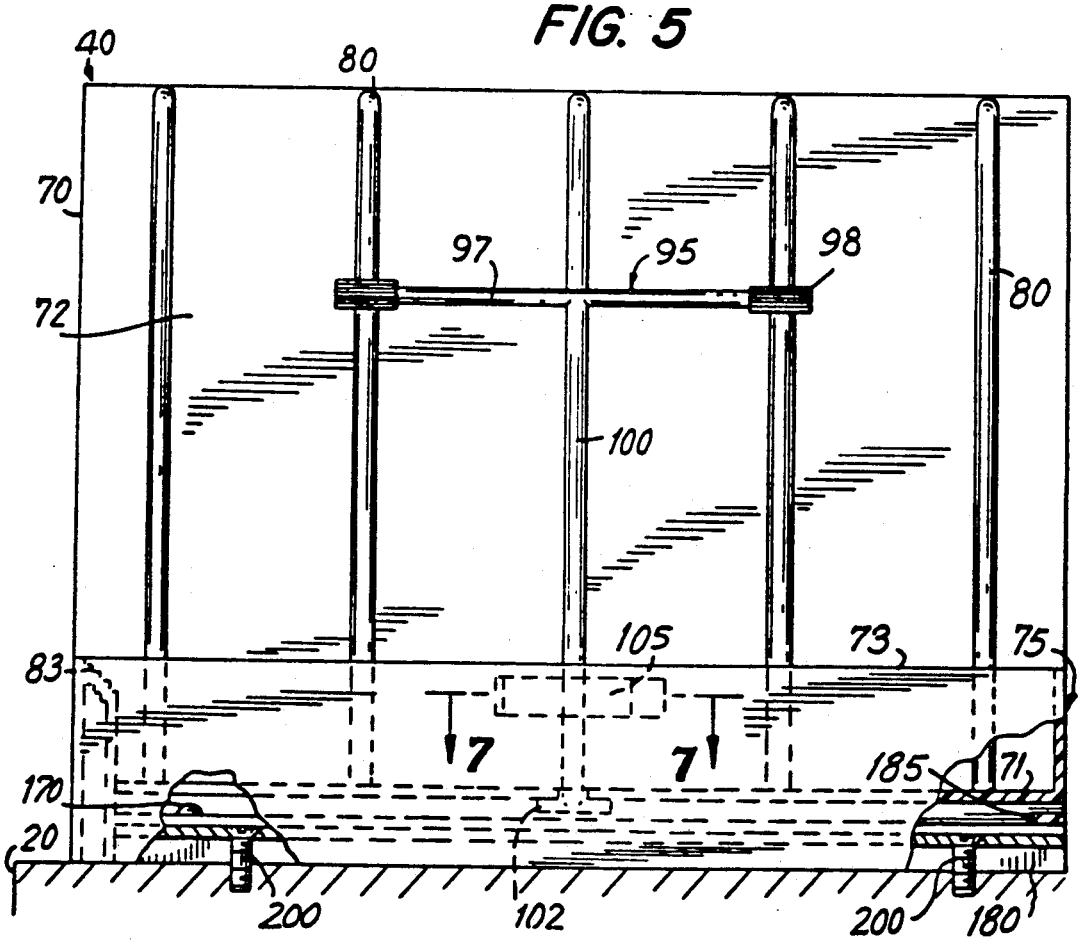
FIG. 5 is a front elevational view of the slidable storage it of FIG. 3 made in accordance with the invention.

Turning now to FIGS. 3, 4 and 5, attached to the inside surface of front wall 74 is a pull 83. Pull 83 is used to grip pocket 85 and thereby gain access to a storage unit 40. By exerting a pulling force when grabbing pull 83, unit 40 may be moved from a first hidden position within compartment 23 to a second retracted position forward of compartment 23.

Continuing now with FIGS. 4–6, a movement enabling assembly generally indicated at 150 for enabling a storage unit 40 to move back and forth between a first hidden position within compartment 23 to a second retracted position forward of compartment 23 is shown. Movement enabling assembly 150 consists of a receptacle 180, a pair of slides 160 suitable for reception by receptacle 180 and a slide preventing mechanism generally indicated at 175 for preventing complete withdrawal of storage unit 40 from compartment 23.

Receptacle 180 is mounted on platform 20 which supports the respective storage unit through the use of screws 200. Receptacle 180 is preferably made of metal or plastic and includes a leading edge 155 and two front legs **202*a* and two back legs 202*b*. Each of legs 202*a* and 202*b* runs the entire length of storage unit 40 and each sits on supporting platform 20. Receptacle 180 also includes a pair of side tracks generally shown at 165 which also run the entire length of unit 40. Each of tracks 165 is defined by an upper member 206 and a lower member 205, as shown in FIG. 6. Each of lower members 205 leads to legs 202*a* and 202*b***, respectively.

Slides 160 comprise two slide members, the first slide 160 protruding from wall 70 and extending inwardly therefrom and the second slide 160 protruding from wall 73 and also extending inwardly therefrom. Slides 160 are slidably retained by the tracks 165 of receptacle 180, enabling storage unit 40 to slide from a first hidden position within compartment 23 to a second retracted position forward of compartment 23.

Slide preventing mechanism 175 consists of a pair of stops 170 and a bumper 185, as shown in FIGS. 4, 6 and 8. Stops 170 consist of semi-circular protrusions rising from the forward most upper surfaces of members 206 of receptacle 180. Stops 170 are located a short distance from leading edge 155 of receptacle 180, as shown in FIGS. 6 and 8.

Bumper 185 is best shown in FIG. 8. Bumper 185 is located below rear wall 75 and above receptacle 180 and is attached to movement enabling assembly 150 at walls 70 and 73, as shown in FIG. 6. Bumper 185 has a leading surface 215 which contacts stops 170 when a storage unit 40 is moved from a first hidden position within a compartment 23 to a second retracted position forward of compartment 23. Once bumper 185 contacts stops 170, storage unit 40 is prevented from moving further forward of compartment 23. Thus, the rear most portion of storage unit 40 remains within compartment 23. This feature prevents complete removal of unit 40 when moved from a first hidden position to a second retracted position, guarding accidental spillage of documents 41.

It will thus be seen that the objects set forth above, among those made apparent from the preceding description, are efficiently attained, and since certain changes may be made in the construction set forth without departing from the spirit and scope of the invention, it is intended that all matter contained on the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed:

1. A file cabinet system for enabling the organization of documents in an economically and easily accessible manner comprising:

a housing having a substantially front opening;

at least one compartment located in said front opening, said compartment selectively retaining a horizontal row of a plurality of storage units; and means for enabling each of said storage units to individually move from a first position in said compartment to a second position forward of said compartment, whereby each of said units is accessible when in said second position;

wherein each of said units includes a pocket having a first side wall at least partially slanted in a vertical direction and laterally extending in the direction in which each of said units is individually movable;

wherein each of said units is adapted for selectively housing at least one document having a substantially planar surface such that said document is supported by said first side wall of said pocket within said unit and said planar surface of said document laterally extends in the direction in which said unit is moveable.

2. The system of claim 1, wherein said housing consists of a top, a bottom, two sides, and a back.

3. The system of claim 1, wherein said housing consists of a means for supporting said plurality of storage units retained within said at least one compartment.

4. The system of claim 1, wherein said housing further comprises at least one independently opening and closing front panel for substantially concealing from view said plurality of storage units retained within said substantially front opening.

5. The system of claim 1, wherein the housing further includes at least one retractable shelf selectively disposed below said at least one compartment.

6. The system of claim 1, wherein said housing includes an upper portion and a lower portion, said at least one compartment located in said upper portion.

7. The system of claim 6, wherein said lower portion includes at least one storage area having at least one hingingly attached door.

8. The system of claim 1, wherein said pocket also includes a bottom wall on which said at least one document is also supported.

9. The system of claim 1, wherein said first side wall further comprises an inside surface having a plurality of running ribs.

10. The system of claim 8, wherein said pocket further includes a second side wall substantially parallel to said first side wall.

11. The system of claim 10, wherein said second side wall is smaller in height than said first side wall to facilitate accessibility into said pocket when said unit is in said second position.

12. The system of claim 1, wherein said pocket further includes a front wall.

13. The system of claim 12, wherein said front wall includes a means for selectively pulling said storage unit from said first position in said compartment to said second position forward of said compartment.

14. The system of claim 12, wherein said front wall includes means for identifying said at least one document retained in said storage unit.

15. The system of claim 1, wherein said storage unit includes means for securing said at least one document retained in said storage unit.

16. The system of claim 15, wherein said securing means comprises an arm assembly.

17. The system of claim 16, wherein said arm assembly comprises a rod for selectively pressing against said at least one document.

18. The system of claim 17, wherein said rod comprises at least one roller guide to facilitate ease of removal of said at least one document from said storage unit.

19. The system of claim 17, further comprising a spring means for urging said rod against said at least one document.

20. The system of claim 3, wherein said moving enabling means comprises a first slide means retained by said storage unit and a second receptacle means mounted on said support, said slide means being slidably engagable with said receptacle means for enabling movement of said storage unit.

21. The system of claim 20, wherein said slide means includes at least one substantially horizontal member and wherein said receptacle means includes at least one track for slidably receiving said at least one substantially horizontal member.

22. The system of claim 20, wherein said moving enabling means further includes means for preventing substantially complete removal of said storage unit from said housing when said unit is moved from said first position to said second position.

23. The system of claim 22, wherein said preventing means includes stopping means and bumper means, wherein said stopping and bumper means interact to retain said storage unit in second position.

24. The system of claim 23, wherein said stopping means is disposed on said receptacle means.

25. The system of claim 23, wherein said bumper means is disposed above said receptacle means.

26. The file cabinet system of claim 1, wherein said first side wall is sized to be at least as large as said document.

* * * * *